US005199759A

United States Patent [19]

Anderson

[11] Patent Number: 5,199,759

[45] Date of Patent: Apr. 6, 1993

[54] FLOOR-MOUNTED DOOR LOCK

[76] Inventor: Ronald D. Anderson, 212 Dawson St., Homer, La. 71040

[21] Appl. No.: 926,760

[22] Filed: Aug. 6, 1992

[51] Int. Cl.[5] ..... E05C 17/54

[52] U.S. Cl. ..... 292/288; 292/DIG. 15

[58] Field of Search ..... 292/343, 288, 258, 289, 292/338, 339, DIG. 15

[56] References Cited

U.S. PATENT DOCUMENTS

| | | | |
|---|---|---|---|
| 280,501 | 7/1883 | Moore . | |
| 349,688 | 9/1886 | Buckingham | 292/339 |
| 521,037 | 6/1894 | McCombe | 292/343 |
| 605,366 | 6/1898 | Winters . | |
| 885,116 | 4/1908 | Whipple | 292/339 |
| 1,082,432 | 12/1913 | Mertsheimer | 292/288 X |
| 1,346,768 | 7/1920 | Ritchie . | |
| 1,467,363 | 9/1923 | Fairall . | |
| 1,487,558 | 3/1924 | Gorham | 292/343 |
| 1,615,823 | 2/1927 | Barclay | 292/343 X |
| 2,762,644 | 9/1956 | Polos | 292/288 |
| 2,870,281 | 1/1959 | Mitchell | 116/85 X |
| 3,804,053 | 4/1974 | Gray | 116/13 |
| 3,854,764 | 12/1974 | Corrigan | 292/289 |
| 3,977,714 | 8/1976 | Trotter | 292/343 |
| 4,630,854 | 12/1986 | Persson et al. | 292/343 |
| 4,705,309 | 11/1987 | Sawchuk | 292/DIG. 15 X |

*Primary Examiner*—Richard E. Moore
*Attorney, Agent, or Firm*—John M. Harrison

[57] ABSTRACT

A floor-mounted door lock which includes in a first preferred embodiment, a floor anchor mounted to the floor near a door threshold in the path of swing of a door and having an upward-standing anchor flange. An anchor wedge is fitted with a bottom slot for removably receiving the anchor flange and obstructing the opening swing of the door. In an alternative preferred embodiment, the floor anchor is provided with a flange opening and the anchor wedge has a downwardly-extending wedge flange for registration with the flange opening and mounting the anchor wedge in position to block opening of the door. In a third preferred embodiment for application to raised thresholds, a flat threshold plate is fitted with an engaging flange on one end for engaging the threshold outside of the door and an upward-standing anchor flange or slot located at the opposite end for interlocking with an anchor wedge to locate the anchor wedge in a position to block the opening swing of the door.

14 Claims, 2 Drawing Sheets

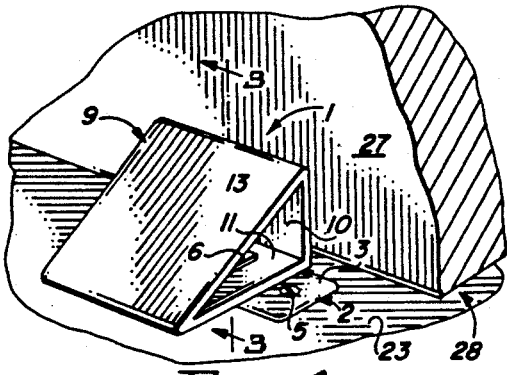
FIG. 1
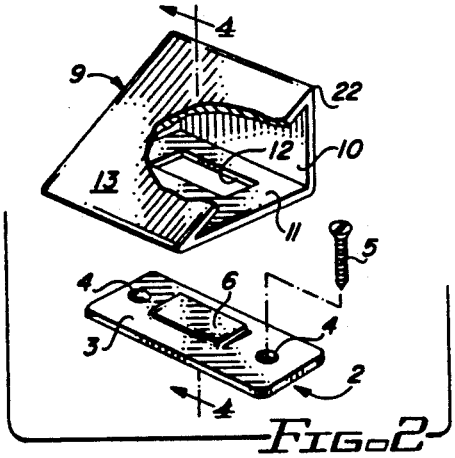
FIG. 2
FIG. 3
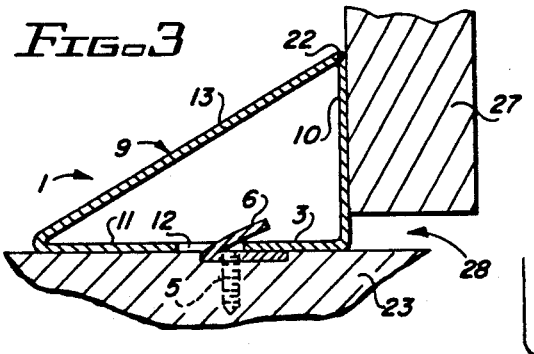
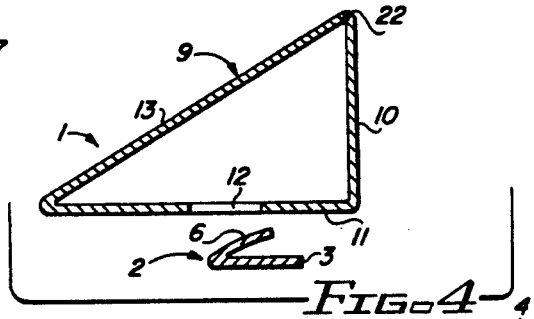
FIG. 4
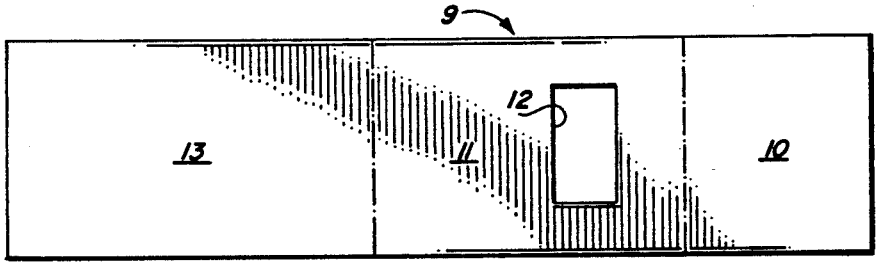
FIG. 5
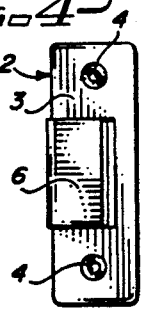
FIG. 7
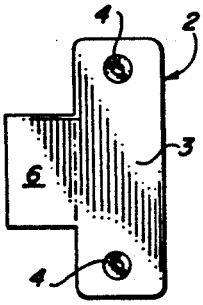
FIG. 6
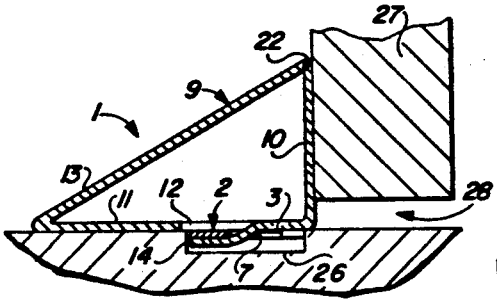
FIG. 8
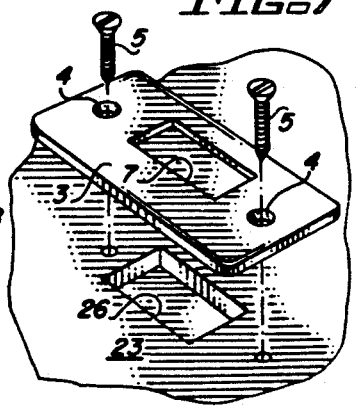
FIG. 9

FLOOR-MOUNTED DOOR LOCK

BACKGROUND OF THE INVENTION

1. Field of the Invention

This invention relates to security devices for homes and commercial buildings and more particularly, to a floor-mounted door lock of the barricade design for securing an inwardly-swinging door while the structure is occupied. The floor-mounted door lock is simple in design, having no moving parts and is portable, positive in operation and easy to use. In a first preferred embodiment the floor-mounted door lock includes a floor anchor secured to the floor of the structure near an entrance door threshold and in the path of swing of the door and an anchor wedge which interlocks with the floor anchor to prevent the door from swinging open. In another preferred embodiment of the invention an elongated threshold plate is configured to engage a raised door threshold on the outside of the structure and extend beneath the door and over the threshold for interlocking with an anchor wedge and preventing the door from opening.

One of the problems encountered in securing inwardly swinging doors in structures, including homes and commercial buildings, is that of constructing a lock system, whether of the doorknob barricade, dead bolt or lock set design, which will withstand the leverage of a crowbar or similar tool. Generally, the doorknob prop or barricade security devices are subject to slippage and while the strength of the lock set or dead bolt is usually not in question, construction of the casement or jamb into which the bolt of the lock set or dead bolt is inserted when in locked configuration, is usually suspect. In most cases, the door casing or jamb is simply splintered and broken away as the door is forced open with a heavy crowbar or like tool. Safety chains and other security devices which are mounted to the casing or jamb and the door in removable, interlocking relationship form somewhat more protection, but also suffer from the disadvantage of being attached directly to the inherently weak casing or jamb, where splintering of the wood allows relatively easy access by application of an appropriate tool.

2. Description of the Prior Art

Most of the external door securing devices detailed in the prior art are of the prop barricade type which fit beneath the door knob and extend to the floor to prevent unauthorized opening of the door. An early "Combined Burglar Alarm and Door Securer" of this design is detailed in U.S. Pat. No. 280,501, dated Jul. 3, 1883, to H. M. and C. E. Moore. The device includes a prop, one end of which is designed to engage the door knob and the other resting on the floor, the prop having a bell mounted thereon for sounding an alarm when pressure is applied to the prop by attempted opening of the door. Another door fastener is detailed in U.S. Pat. No. 605,366, dated Jun. 7, 1898, to G. D. Winters, entitled "Barricade Alarm for Doors". The alarm system includes an elongated prop having an engaging device at one end for engaging the door knob and the opposite end of the prop resting on the floor, with a bell system mounted on the prop for sounding an alarm when pressure is applied to the prop responsive to opening the door. U.S. Pat. No. 2,870,281, dated Jan. 20, 1959, to F. E. Mitchell, details a "Burglar Alarm" which is electrically operated and includes a prop, one end of which is mounted on the door knob and the other resting against the floor. A spring is provided in the prop and compresses responsive to pressure applied to the door, to sound an alarm. U.S. Pat. No. 1,346,768, dated Jul. 13, 1920, to S. Richey, details a "Portable Automatic Door Lock and Burglar Alarm" having an engaging fork at each end, with the top engaging fork resting against the door and the bottom against the floor. A pair of chambers are built into the device and two springs are used to activate an alarm system responsive to pressure applied to the door. U.S. Pat. No. 1,467,363, dated Sep. 11, 1923, to W. T. Farall, details a "Combined Door Check and Burglar Alarm". The device includes an elongated, spring-loaded prop having door-engaging and floor-engaging members on the ends and a cartridge mounted in the device against the bias in the spring, such that compression of the spring responsive to opening a door fires a cartridge and not only awakens the occupant, but hopefully deters the burglar. U.S. Pat. No. 3,804,053 dated Apr. 16, 1974, to James R. Gray, details a "Combination Stop and Alarm". The device is designed for mounting on a door or window and pivoting into secured position with the free end resting against the floor or window seat. The device includes a container of pressurized gas combined with a sound generator which is activated upon opening the door or raising the window.

It is desirable to provide a floor-mounted, barricade-type security device for securing an inwardly-swinging door against unauthorized opening in a safe, efficient and highly reliable manner.

It is therefore an object of this invention to provide a floor-mounted door lock of the barricade design which includes a floor-mounted anchor and an anchor wedge which may be removably interlocked with the floor anchor to block the inward swing of the door.

Another object of this invention is to provide a floor-mounted door lock which is characterized by a floor anchor mounted in close proximity to the threshold in a structure within the inwardly-swinging path of the door and an anchor wedge designed to removably interlock with the floor anchor and prevent the door from opening at all or past a predetermined point.

Yet another object of this invention is to provide a floor-mounted door lock which includes a floor anchor adapted for securing to the floor of a structure near the threshold and in the inward path of swing of a door, the floor anchor provided with an upward-standing anchor flange designed to removably register with a corresponding slot located in the bottom of an anchor wedge, such that the anchor wedge interlocks with the anchor plate and prevents opening of the door past a predetermined point.

Still another object of this invention is to provide a floor-mounted door lock which includes a floor anchor having a flange opening and secured to the floor of a structure adjacent to the threshold within the path of swing of an inwardly-opening door and an anchor wedge fitted with a downwardly-extending flange shaped to removably engage the flange opening in the floor anchor and prevent the door from swinging on its hinges past a predetermined point.

A still further object of this invention is to provide a floor-mounted door lock which is characterized by an elongated, flat threshold plate fitted with a reverse bend at one end for engaging the outside edge of the raised threshold of a door at the exterior of the structure and extending transversely between the door and threshold, with an upward-standing anchor flange or slot provided in the opposite end of the threshold plate inside the structure for removably engaging an anchor wedge and securing the anchor wedge in position to prevent opening of the door past a predetermined point.

SUMMARY OF THE INVENTION

These and other objects of the invention are provided in a new and improved, two-piece, floor-mounted door lock which is characterized by an anchor plate engaging or mounted adjacent to the threshold of a home, office or other structure in the inward path of swing of a door and a triangular-shaped anchor wedge adapted to removably interlock with the floor anchor to prevent the door from opening at all or past a predetermined point.

BRIEF DESCRIPTION OF THE DRAWING

The invention will be better understood by reference to the accompanying drawings, wherein:

FIG. 1 is a perspective view of a first preferred embodiment of the floor-mounted door lock of this invention;

FIG. 2 is an exploded view of the floor-mounted door lock illustrated in FIG. 1;

FIG. 3 is sectional view taken along line 3—3 of the floor-mounted door lock illustrated in FIG. 1;

FIG. 4 is a sectional view taken along line 4—4 of the floor-mounted door lock illustrated in FIG. 2;

FIG. 5 is a top view of a metal plate which will be configured to shape the anchor wedge element of the floor-mounted door lock illustrated in FIGS. 1-4;

FIG. 6 is a top view of one embodiment of the floor anchor element of the floor-mounted door lock, with the anchor flange not yet shaped to engage the anchor wedge element;

FIG. 7 is a top view of the floor anchor element illustrated in FIG. 6, with the anchor flange bent to engage the anchor wedge element;

FIG. 8 is a sectional view of a second preferred embodiment of the floor-mounted door lock;

FIG. 9 is an exploded view of a preferred configuration of the floor anchor element illustrated in FIG. 8;

DESCRIPTION OF THE PREFERRED EMBODIMENTS

Figure 10:
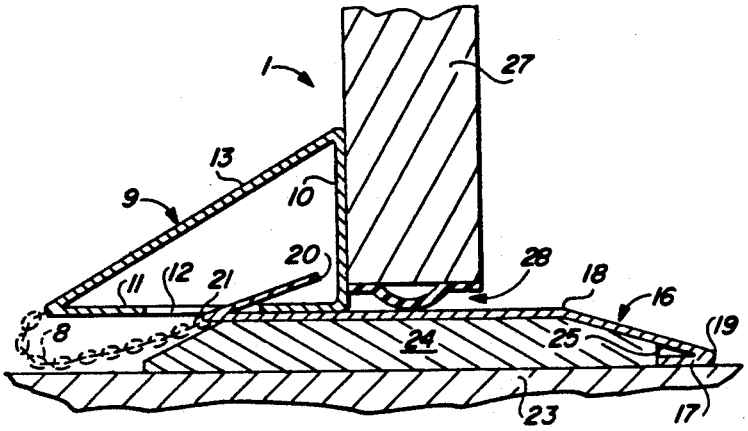
FIG. 10 is a sectional view of a third preferred embodiment of the floor-mounted door lock.

Referring initially to FIGS. 1-8 of the drawings, in a first preferred embodiment the floor-mounted door lock of this invention is generally illustrated by reference numeral 1. The floor-mounted door lock 1 includes a metal floor anchor 2, which is characterized by a flat anchor plate 3, having spaced plate openings 4 for receiving anchor screws 5 and securely mounting the anchor plate 3 to the floor 23 in close proximity to a door 27. The door 27 is hung in conventionally hinged fashion, such that it is constrained to swing inwardly from closure, over the floor 27 and the floor anchor 2 when the anchor plate 3 is securely anchored to the floor 23 by means of the anchor screws 5. The door clearance 28 between the bottom surface of the door 27 and the floor 23 is such that the door 27 easily clears the floor anchor 2, as illustrated in FIG. 3. The anchor plate 3 of the floor anchor 2 is fitted with an upwardly-projecting anchor flange 6, which extends from one edge of a floor plate slot 12 as illustrated in FIGS. 1 and 2, and alternatively, from an outside edge of the anchor plate 3, as illustrated in FIGS. 3, 4, 6 and 7, in angular relationship with respect to the plane of the anchor plate 3, toward the door 27. Furthermore, a floor plate slot 12 is provided in the horizontal floor plate 11 of a metal triangular-shaped anchor wedge 9, which is constructed of a single metal plate to define a vertical door plate 10, a horizontal floor plate 11 extending from the bottom edge of the vertical door plate 10 and a top plate 13 projecting in inclined fashion from the floor plate 11 to the top edge of the door plate 10, where it is attached by a welded seam 22. This facilitates placement of the anchor wedge 9 on the floor anchor 2 such that the anchor flange 6 of the anchor plate 3 engages the floor plate slot 12 of the anchor wedge 9 and the corresponding interlocking of the anchor wedge 9 with the floor anchor 2 prevents rearward movement of the anchor wedge 9 in the direction of opening of the door 27. Accordingly, the door 27 is effectively prevented from opening at all or past a predetermined point, which point is determined by the placement and positioning of the floor anchor 2 and the anchor wedge 9 on the floor anchor 2 with respect to the door 27.

In a second preferred embodiment of the invention, and referring to FIGURES 8 and 9 of the drawings, a flange opening 7 is provided in the anchor plate 3 of the floor anchor 2 and that portion of the floor 23 which is exposed in the flange opening 7 is formed or removed by means of a chisel, drill or other tool to provide a depression or mortise 26 within the confines of the flange opening 7, for purposes which will be hereinafter further described. The companion element of the floor-mounted door lock 1 is the metal triangular-shaped anchor wedge 9. A floor plate slot 12 is formed in the horizontal floor plate 11 of the anchor wedge 9 as a floor plate flange 14 is pressed from the horizontal floor plate slot 11 in downwardly-extending, angular relationship, as further illustrated in FIG. 8. The floor plate flange 14 extends angularly downwardly in a direction away from the vertical door plate 10 to facilitate registration of the floor plate flange 14 with the flange opening 7 in the anchor plate 3 of the floor anchor 2 and removably interlock the anchor wedge 9 with the floor anchor 2, as further illustrated in FIG. 8. Accordingly, it will be appreciated from a consideration of FIG. 8, that when the anchor wedge 9 is so interlocked with the floor anchor 2, the door 27 is prevented from opening at all, or past a predetermined position as the door 27 contacts the vertical door plate 10 of the anchor wedge 9 and cannot be opened any further without moving or dislodging the anchor wedge 9. However, opening of the door 27 is easily achieved upon removal of the anchor wedge 9 from the floor anchor 2 by lifting the anchor wedge 9 and removing the floor plate flange 14 from the corresponding flange opening 7 in the anchor plate 3.

In yet another preferred embodiment of the invention and referring now to FIGS. 10-13 of the drawings, a raised or elevated threshold 24 is illustrated beneath the door 27 and a threshold plate 16 is configured with a proximity bend 18 and a reverse bend 19 in one end, the latter of which defines a rearwardly-projecting engaging flange 17, designed to engage the threshold lip 25 of the threshold 24 outside of the door 27. The threshold plate 16 extends transversely between the door 27 and the threshold 24 and terminates inside the structure, where an anchor flange 20 extends forwardly and upwardly from an anchor bend 21 in the threshold plate 16, to project through the corresponding floor plate slot 12 of the anchor wedge 9 and prevent the door 27 from swinging open past a predetermined point. Alternatively, the end of the threshold plate 16 which terminates inside the structure may be provided with a slot {not illustrated), for receiving the floor plate flange 14 of the anchor wedge 9, in an installation similar to that illustrated in FIGS. 8 and 9.

Figure 11:
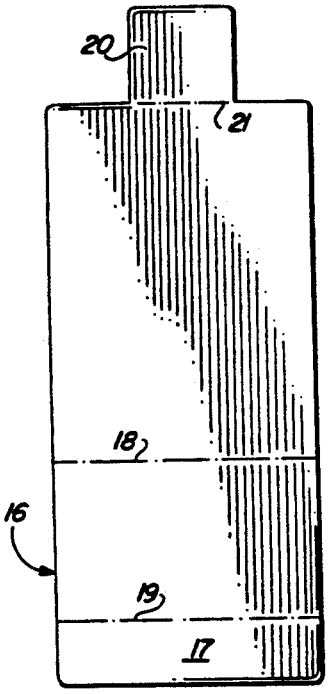
FIG. 11 is a top view of the threshold plate element of the floor-mounted door lock illustrated in FIG. 10 not yet shaped in final form.
Figure 12:
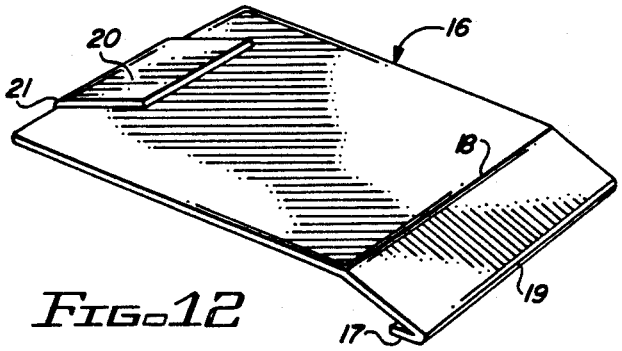
FIG. 12 is a perspective view of the threshold plate element illustrated in FIG. 11.
Figure 13:
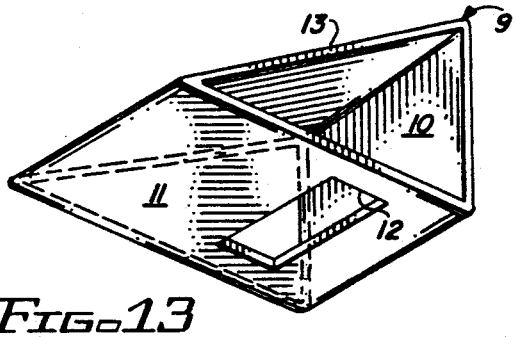
FIG. 13 is a bottom perspective view of the wedge anchor element illustrated in FIG. 10.

It will be appreciated by those skilled in the art that the floor-mounted door lock 1 of this invention, in all of the embodiments described above, offers an effective way to prevent opening of a door 27 past a predetermined point, regardless of the pressure applied to the door 27 from the outside, so long as the door hinges and door do not fail. It will be further appreciated that the floor anchor 2 in either of the two design embodiments illustrated in FIGS. 1-9 may be securely anchored to the floor 23 adjacent to the door 27 by two or more fasteners, such as anchor screws 5 or bolts (not illustrated) as desired, to prevent movement of the floor anchor 2 and anchor wedge 9 rearwardly by pressure applied to the door 27. The anchor plate 3 may be recessed in a mortised slot (not illustrated) provided in the floor 23 under circumstances where the upward-standing anchor flange 6 extends through the door clearance 28 and strikes the door 22. Since the anchor wedge 9 is most preferably designed in a triangular, wedge-shaped configuration with the floor plate slot 12 (FIGS. 1-5) and floor plate flange 14 (FIG. 8) located forwardly of the center of the horizontal floor plate 11, pressure applied to the vertical door plate 10 by the door 27 forces the rear portion of the horizontal floor plate 11 downwardly against the floor to bind or wedge the anchor wedge 9 and further increase friction and resistance to shearing of the anchor screws 5. Furthermore, since the floor 23 is stronger than any segment or portion of the entire door casing and jamb system, anchoring the floor anchor 2 to the floor 23 provides the strongest possible facility for preventing unauthorized opening of the door 27 on its hinges, either from a fully closed position or past a predetermined point. It will also be appreciated that the floor anchor 2 can be located in a chosen proximity with respect to the threshold 24 or door 27 to allow the door 27 to be opened a predetermined distance, if desired, for safe inspection outside. Alternatively, the floor anchor 2 can be located immediately adjacent to the threshold 24 or door 27 to prevent opening of the door 27 substantially past its normally closed position. Furthermore, in the embodiments of the invention illustrated in FIGS. 1-9, the door threshold need not be raised or elevated. However, under circumstances where a threshold plate 16 of desired length is used as illustrated in FIGS. 10 and 11, the threshold 24 must be raised in order to define the threshold lip 25 and accommodate the engaging flange 17 of the threshold plate 16.

In a most preferred embodiment of the invention, the anchor wedge 9 is constructed of metal plate in a triangular configuration for maximum strength, with the vertical door plate 10, horizontal floor plate 11 and top plate 13 shaped from a single piece of metal, welded at a single welded seam 15. As such, the anchor wedge 9 is a compact, strong unit which can easily be carried in a suitcase along with a threshold plate 16, for application in a hotel or motel room to further secure the room. The anchor wedge 9 may be attached to the threshold plate 16 by a chain 8, as illustrated in FIG. 10.

While the preferred embodiments of the invention have been described above, it will be recognized and understood that various modification may be made in the invention and the appended claims are intended to cover all such modifications which may fall within the spirit and scope of the invention.

Having described my invention with the particularity set forth above, what is claimed is:

1. A floor-mounted door lock comprising anchor means disposed on a floor in fixed relationship in the path of swing of a door a door plate for engaging the door, a floor plate extending from said door plate and a floor plate slot provided in said floor plate for removably engaging said anchor means and blocking opening of the door.

2. The floor-mounted door lock of claim 1 wherein said anchor means further comprises an anchor plate, at least one fastener opening provided in said anchor plate, at least one fastener extending through said fastener opening into the floor for securing said anchor plate to the floor and anchor plate flange means projecting from said anchor plate for removably engaging said floor plate slot and securing said floor plate to said anchor plate in the path of swing of the door.

3. The floor-mounted door lock of claim 2 wherein said anchor plate flange means further comprises a flat anchor plate flange projecting from said anchor plate in angular relationship for projecting into said floor plate slot and removably interlocking with said floor plate.

4. The floor-mounted door lock of claim 1 further comprising floor plate flange means projecting from said floor plate for removably engaging said anchor means and securing said door plate in the path of swing of the door.

5. The floor-mounted door lock of claim 1 wherein said anchor means further comprises an anchor plate, at least one fastener opening provided in said anchorplate, at least one fastener opening provided in said anchor plate, at least one fastener extending through said fastener opening into the floor for securing said anchor plate to the floor and an anchor plate flange opening provided in said anchor plate; and further comprising floor plate flange means projecting from said floor plate for extending through said anchor plate flange opening and securing said door plate in the path of swing of the door.

6. The floor-mounted door lock of claim 5 wherein said floor plate flange means further comprises a flat floor plate flange projecting from said floor plate in angular relationship for projecting into said anchor plate flange opening and removably interlocking with said anchor plate.

7. The floor-mounted door lock of claim 1 including a raised threshold located beneath the door, the threshold having an outside edge and wherein said anchor means further comprises a threshold plate for positioning transversely across the threshold, an engaging flange provided on one end of said threshold plate for engaging the outside edge of the threshold and connecting means provided on the opposite end of said threshold plate for removably engaging said floor plate slot and securing said floor plate to said threshold plate in the path of swing of the door.

8. The floor-mounted door lock of claim 7 wherein said connecting means further comprises a threshold plate flange projecting from said opposite end of said threshold plate for removably engaging said floor plate slot.

9. The floor-mounted door lock of claim 7 further comprising floor plate flange means projecting from said floor plate and wherein said connecting means further comprises a threshold plate slot provided in said opposite end of said threshold plate for removably receiving said floor plate flange means.

10. The floor-mounted door lock of claim 9 wherein said floor plate flange means further comprises a flat floor plate flange projecting from said floor plate in angular relationship for projecting into said threshold plate slot and removably interlocking with said threshold plate.

11. A floor-mounted door lock for securing a door in closed position over a threshold, comprising anchor means attached to the floor adjacent to the threshold; an anchor slot provided in said anchor means; and wedge means having a wedge flange projecting downwardly from said wedge means in angular relationship for extending into said anchor slot and removably securing said wedge means in the path of swing of the door and blocking opening of the door.

12. A floor-mounted door lock for securing an inwardly-swinging door in closed position over a raised threshold having an exterior edge outside of the door and an interior edge inside of the door, comprising elongated threshold plate means positioned transversely over the threshold beneath the door; threshold engaging means provided on one end of said threshold plate means for engaging the exterior edge of the threshold; plate connecting means provided on the opposite end of said threshold plate means adjacent the interior edge of the threshold; and wedge means having wedge connecting means for removably engaging said plate connecting means and securing said wedge means in the path of swing of the door and blocking opening of the door.

13. The floor-mounted door lock of claim 12 wherein said plate connecting means further comprises a threshold plate flange projecting upwardly from said opposite end of said threshold plate means and said wedge connecting means further comprises a wedge slot provided in said wedge means for receiving said threshold plate flange and removably securing said wedge means to said threshold plate means.

14. The floor-mounted door lock of claim 12 wherein said plate connecting means further comprises a threshold plate slot provided in said opposite end of said threshold plate means and said wedge connecting means further comprises a wedge flange projecting downwardly from said wedge means in angular relationship for extending into said threshold plate slot and removably securing said wedge means to said threshold plate means.

* * * * *